United States Patent [19]

Haesly et al.

[11] 4,276,460

[45] Jun. 30, 1981

[54] PRINTED CIRCUIT BOARD SWITCH

[75] Inventors: Barry F. Haesly, Richardson; Hall E. Jarman, Princeton, both of Tex.

[73] Assignee: Texas Instruments Incorporated, Dallas, Tex.

[21] Appl. No.: 42,847

[22] Filed: May 29, 1979

[51] Int. Cl.[3] ..... H01H 9/00

[52] U.S. Cl. ..... 200/292; 200/11 D; 200/252

[58] Field of Search ..... 200/292, 283, 273, 155 R, 200/11 D, 11 G, 293, 252, 260

[56] References Cited

U.S. PATENT DOCUMENTS

| | | | |
|---|---|---|---|
| 2,079,003 | 5/1937 | Dick | 200/293 |
| 2,632,830 | 3/1953 | Aust et al. | 200/252 |
| 2,794,081 | 5/1957 | Luhn | 200/292 |
| 3,476,901 | 11/1969 | Werda | 200/292 |
| 3,518,389 | 6/1970 | Doering, Jr. et al. | 200/11 G |
| 3,594,527 | 7/1971 | Brant | 200/283 |
| 4,038,504 | 7/1977 | McAnulty et al. | 200/292 |
| 4,042,795 | 8/1977 | Sykora | 200/252 |
| 4,057,520 | 11/1977 | Schwartz | 200/303 |
| 4,082,925 | 4/1978 | Hufford | 200/11 G |

FOREIGN PATENT DOCUMENTS

| | | | |
|---|---|---|---|
| 2612452 | 9/1977 | Fed. Rep. of Germany | 200/159 B |

*Primary Examiner*—John W. Shepperd

*Attorney, Agent, or Firm*—Gary C. Honeycutt; Richard L. Donaldson; Melvin Sharp

[57] ABSTRACT

A switch consisting of a housing and a spring is provided with convenient attachment means for assembly in combination with a printed circuit board. The spring functions as both an electrical connection means, and as a tension mechanism for biasing the assembly to compensate for tolerances.

5 Claims, 5 Drawing Figures

Fig. 1
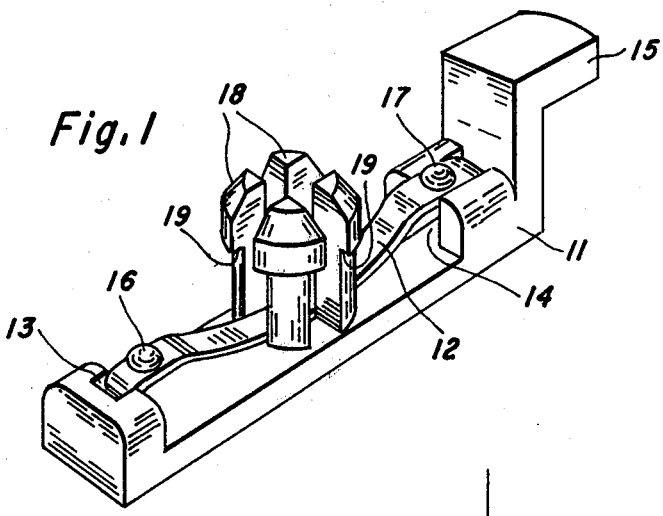
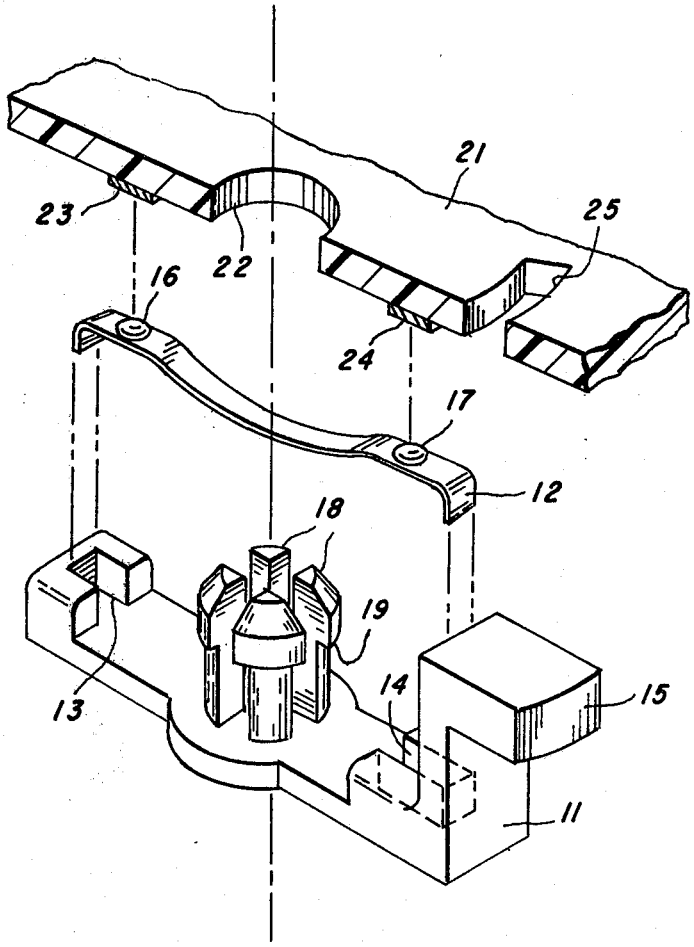
Fig. 2

Fig. 3
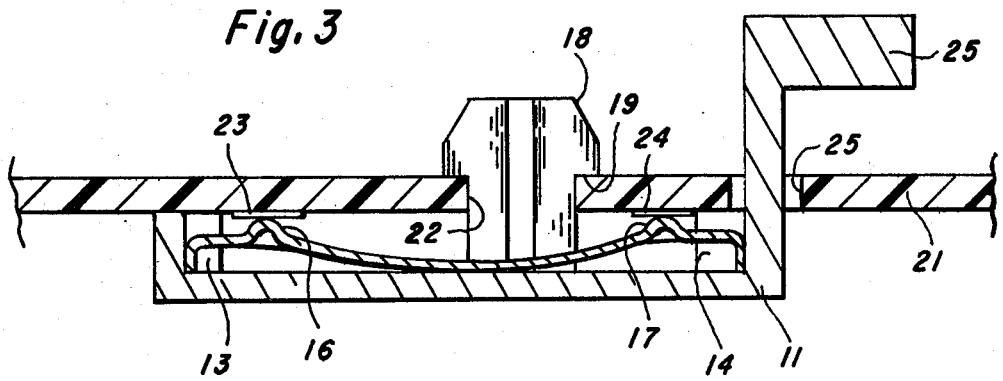
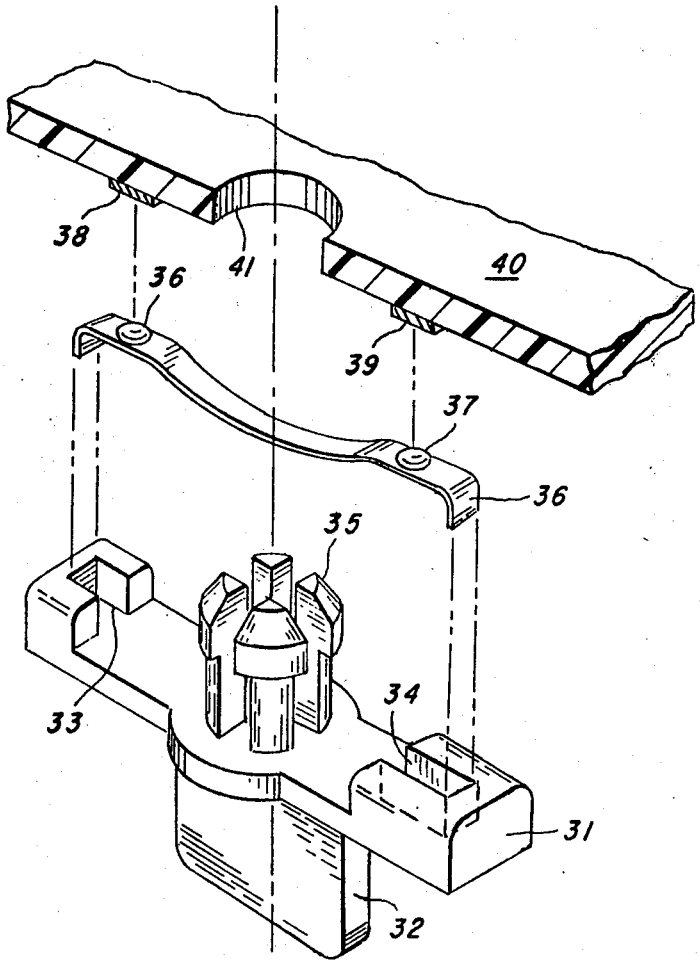
Fig. 4

PRINTED CIRCUIT BOARD SWITCH

This invention relates to electrical switches and more particularly to a simple, reliable, spring-biased switch assembly for circuit boards or the like.

In the manufacture of low-cost electronic systems such as toys and games, for example, there has been a continuing need for an improved "on"-"off" switch or function-selector switch that is cost effective, yet reliable and easily assembled or disassembled.

Some switches are disproportionately expensive or troublesome in that they consist of an excessive number of pieceparts and in that they require soldering or adhesive bonding, or special tools for assembly-line fabrication. The present invention avoids these problems by reducing the switch to only two pieces, and eliminating any bonding steps or special tool requirements.

One aspect of the invention is embodied in a switch sub-assembly comprising a housing and spring adapted for combination with a circuit board. The housing is provided with a post or beveled "dart", or the like, to be fitted into a hole in the circuit board, with the spring nested between the housing and the board. The spring is shaped to function as an electrical contact in combination with contacts provided on the circuit board, and also to function as a biasing member which presses against the board and the housing to hold the switch firmly in any position set by the operator.

Another embodiment of the invention is a printed circuit board having the above-described switch assembled thereon. The board includes a suitable substrate having a known conductor pattern thereon, including at least one pair of switch contacts, and a hole in the substrate near the contacts. The switch assembly includes a non-conductive housing member that extends in part through the hole, and a conductive spring nested between the substrate and housing so as to bias the assembly and thereby hold it in any pre-set position. The spring is shaped to include contact points which make selective contact with the circuit board contacts, and break contact upon turning or sliding the switch assembly. That is, a rotary displacement is provided by a circular hole; while linear sliding action is provided by an elongated slot.

A function selector switch embodiment is provided by arranging a plurality of contact pairs on the board, such that any given pair is selected by rotating or sliding the switch housing to the respective position that corresponds to the desired pair location.

The housing is molded or otherwise shaped to include means for retaining the spring in place. Slots or shoulders, or ridges of sufficient size are provided for this purpose, whereby displacement of the housing carries the spring to the same position as the housing. The housing is provided with a suitable knob or handle for convenient setting of a desired position.

The switch assembly is equally suited for location at the edge of the circuit board or any location away from an edge. Also, the knob or handle is located either on the same side as the contacts, or on the opposite side.

FIG. 1 is a perspective view of one embodiment of the switch sub-assembly of the invention.

FIG. 2 is an exploded perspective view, partly in cross-section, of one embodiment of the circuit board switch assembly of the invention.

FIG. 3 is a cross-sectional view of the embodiment of FIG. 2, fully assembled.

FIG. 4 is an exploded perspective view, partly in cross-section, of another embodiment of the circuit board switch assembly of the invention.

Figure 5:
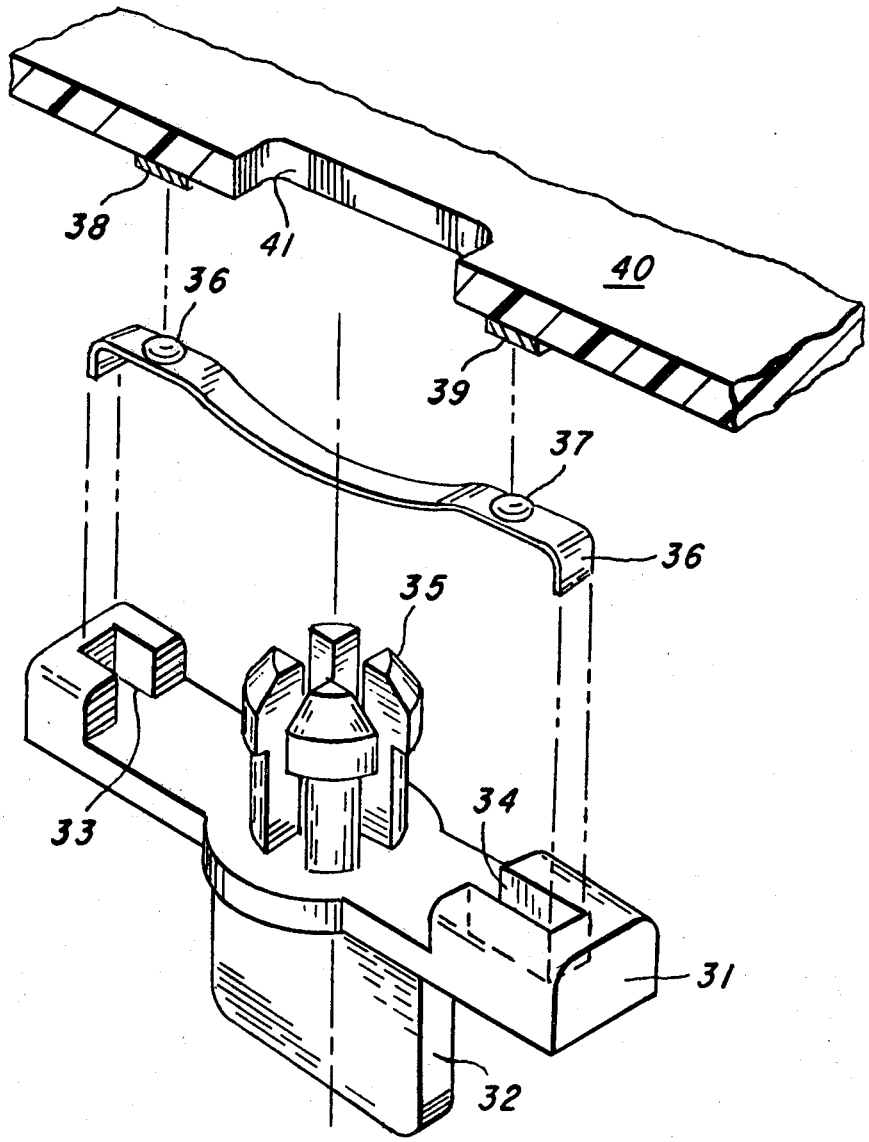
FIG. 5 is a perspective view of another embodiment of the circuit board switch assembly of the invention.

In FIG. 1, the switch sub-assembly is seen to comprise housing 11, made of plastic, nylon, or other non-conductive material and spring 12. Member 11 is shaped to include first and second slots, or other nesting means, 13 and 14 for retaining spring 12 in place. A handle or knob 15 is also provided. The spring is made of copper, copper alloy, steel, or other conductive material, and is shaped to include contacts 16 and 17 which are spaced to coincide with contacts located on a circuit board or the like, to which the sub-assembly is attached.

Attachment of the sub-assembly to a circuit board is obtained by pressing the flexible, beveled prongs 18 into a hole in the board, such that shoulders 19 extend through the hole and thereby fix the assembly in place.

In FIG. 2, the embodiment of FIG. 1 is shown in its relationship to board 21, which includes hole 22, contacts 23 and 24, and slot 25 through which handle 15 is located. Board 21 is a printed circuit board having known circuit patterns thereon, and electrical contacts 23 and 24 which are connected by spring 12, when set in the indicated position. By moving knob 15 on one side, the contacts are disengaged to turn the circuit "off".

FIG. 3 is a cross-section of the embodiment of FIG. 2, fully assembled.

In FIG. 4 another embodiment of the invention is shown, including housing 31 having a knob 32, retaining slots 33 and 34, and beveled prongs or post 35. Spring 36 fits into slots 33 and 34, extends between the prongs and includes contacts 36 and 37 which connect with contacts 38 and 39 on board 40, which also includes a hole 41 through which prongs 35 are extended for assembly.

In FIG. 5, the embodiment of FIG. 4 is shown, having an elongated slot 41 to accommodate the linear sliding action of one embodiment. The remainder of the embodiment is identical to FIG. 4, including reference numbers.

In each of the above embodiments it is readily seen that the spring must be shaped so that upon assembly it touches the board before full insertion of the prongs through the hole in the board, whereby tension is placed on the spring from further insertion of the prings to complete the assembly. The board and housing are thereby biased, to keep the assembly "tight" and hold the switch at set positions.

What is claimed is:

1. A switch subassembly adapted for combination with a circuit board comprising:

(a) a non-conducting elongated housing shaped to include a circular post sized for insertion into opening on said circuit board and having a beveled outer edge, the outermost length of the post shaft having a larger diameter than the innermost part, creating a shoulder at the junction of the two sizes of the post; said post having a first slot cut therein, the centerline of said slot in said post coincidental with the centerline of the housing base long dimension, also said post having a second slot cut therein, perpendicular to said first slot; said housing also including a raised section on either end, each said section having a notch cut into the raised section, said notch having the same width and a centerline coincident with said centerline of said first notch;

said housing also to include a handle at one end of housing; and (b) a conductive spring, formed as a flat ribbon, having two contact surfaces, with a concave shape between the two contact surfaces, and each end bent downward to provide support for said contact surfaces, located in said housing in said first slot in said shaft, the ends of said spring fitted in said notches cut into raised sections of said housing.

2. A switch assembly as in claim 1, wherein said opening has a circular configuration causing switch motion to be rotary when closing or opening contacts.

3. A switch assembly as in claim 1, said opening comprising a slot with rounded ends, causing switch motion to be a sliding straightline motion, when closing or opening contacts.

4. A switch assembly as in claim 1, wherein handle for operation of switch is on opposite side of housing base from said conductive spring.

5. A switch assembly as in claim 1, in combination with a printed circuit board having a substrate, first and second conductive contacts, and an opening, wherein said post is inserted into said opening with said spring in place in said housing, compressing said spring so that electrical contact is made between said spring and said circuit board and bias exists between said housing and said circuit board to maintain set position.

* * * * *